US007568915B1

(12) United States Patent
Lavoie

(10) Patent No.: US 7,568,915 B1
(45) Date of Patent: Aug. 4, 2009

(54) WRITING BOARD WITH CONVERTIBLE STAND

(76) Inventor: Robbie L. Lavoie, 60 Park Hill Ct., Strafford, MO (US) 65757

( * ) Notice: Subject to any disclaimer, the term of this patent is extended or adjusted under 35 U.S.C. 154(b) by 836 days.

(21) Appl. No.: 11/243,659

(22) Filed: Oct. 5, 2005

(51) Int. Cl.
*B43L 1/00* (2006.01)

(52) U.S. Cl. ..... 434/408; 434/421

(58) Field of Classification Search ..... 434/408, 434/416, 420, 421, 428, 430; 248/441.1, 248/447.1, 447.2, 454–455, 457–458, 463–464, 248/682, 685, 688, 691
See application file for complete search history.

(56) References Cited

U.S. PATENT DOCUMENTS

| | | | | | |
|---|---|---|---|---|---|
| 184,541 | A | | 11/1876 | Minehart | |
| 259,216 | A | * | 6/1882 | Rood | 248/464 |
| 1,197,351 | A | * | 9/1916 | Dalglish | 248/464 |
| 1,457,990 | A | * | 6/1923 | Morgan | 248/456 |
| 2,456,103 | A | | 12/1948 | Amstutz | |
| 2,746,202 | A | | 5/1956 | Barker | |
| 3,195,849 | A | * | 7/1965 | Maddox | 248/441.1 |
| 3,550,291 | A | * | 12/1970 | Albright | 434/419 |
| 4,239,170 | A | | 12/1980 | Planebo | 248/441 B |
| 4,403,761 | A | * | 9/1983 | Jamar | 248/447.1 |
| 4,460,145 | A | * | 7/1984 | Ando | 248/447 |
| 4,684,099 | A | * | 8/1987 | Krapf | 248/447.1 |
| 6,328,571 | B1 | | 12/2001 | Dricken et al. | 434/408 |
| 6,895,704 | B2 | | 5/2005 | Ives et al. | 40/493 |
| 6,941,691 | B2 | * | 9/2005 | Arko et al. | 40/611.11 |
| 7,124,988 | B1 | * | 10/2006 | Duffy et al. | 248/284.1 |

* cited by examiner

*Primary Examiner*—Kurt Fernstrom
(74) *Attorney, Agent, or Firm*—Jonathan Bay

(57) ABSTRACT

A writing board has a convertible stand. Left and right standards pivot at the writing board's sides by a sliding linking mechanism, and their free ends are formed with hooks so that a selection of the following can be achieved. That is, the writing board might be hung on a door with the hook ends of the standards swung up over the door's top edge. The standards might be swung down to stand the writing board off the floor as a floor stand. The standards' linked ends might be slid up high along the sides of the writing board, and swung back a little, to prop the writing board in the manner as a book easel. Whereas a floor stand manner of standing the writing board puts it between about waist and shoulder high, a book easel manner rests its bottom edge on a desk or podium.

20 Claims, 6 Drawing Sheets

WRITING BOARD WITH CONVERTIBLE STAND

BACKGROUND AND SUMMARY OF THE INVENTION

The invention relates to education and demonstration devices and, more particularly, to not only bulletin boards or paper-tablet hangers but also chalk boards or equivalents thereto having an easily erasable surface.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
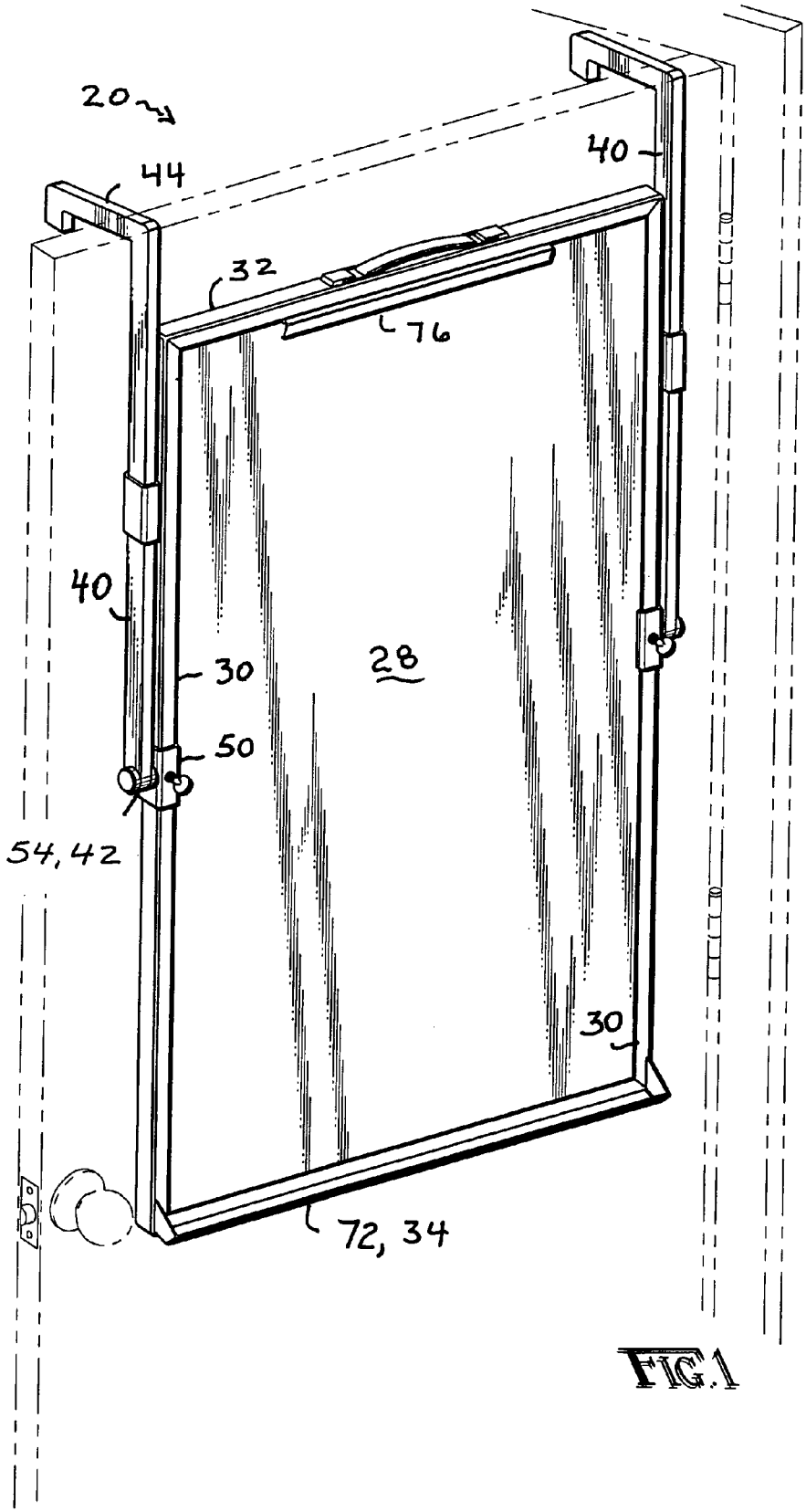
FIG. 1 is a perspective view of a combination writing board and convertible stand in accordance with the invention, and as shown hung on a door shown in broken lines for illustrative purposes.

FIG. 1 shows a combination writing board and convertible stand 20 in accordance with the invention. The invention relates to, not only bulletin boards or paper-tablet hangers but also, chalk boards or equivalents thereto having an easily erasable surface. Hence the phrase "writing board" refers to not only supporting a surface for direct application of lettering, drawing, and artistry or the like, but also a surface for thumb-tacking thereto pre-printed materials of the same.

Again, FIG. 1 shows a combination writing board an convertible stand 20. The writing board portion of the invention is generally planar and a has a central framed portion 28 as well as a frame which has left and right stiles 30 as well as top and bottom rails 32 and 34.

The stand portion of the invention comprises left and right standards 40 that extend between inner or linked ends 42 and outer or free ends 44, which are formed with crook spans 44, and these terminate in hooked-back tip ends 46.

Figure 2:
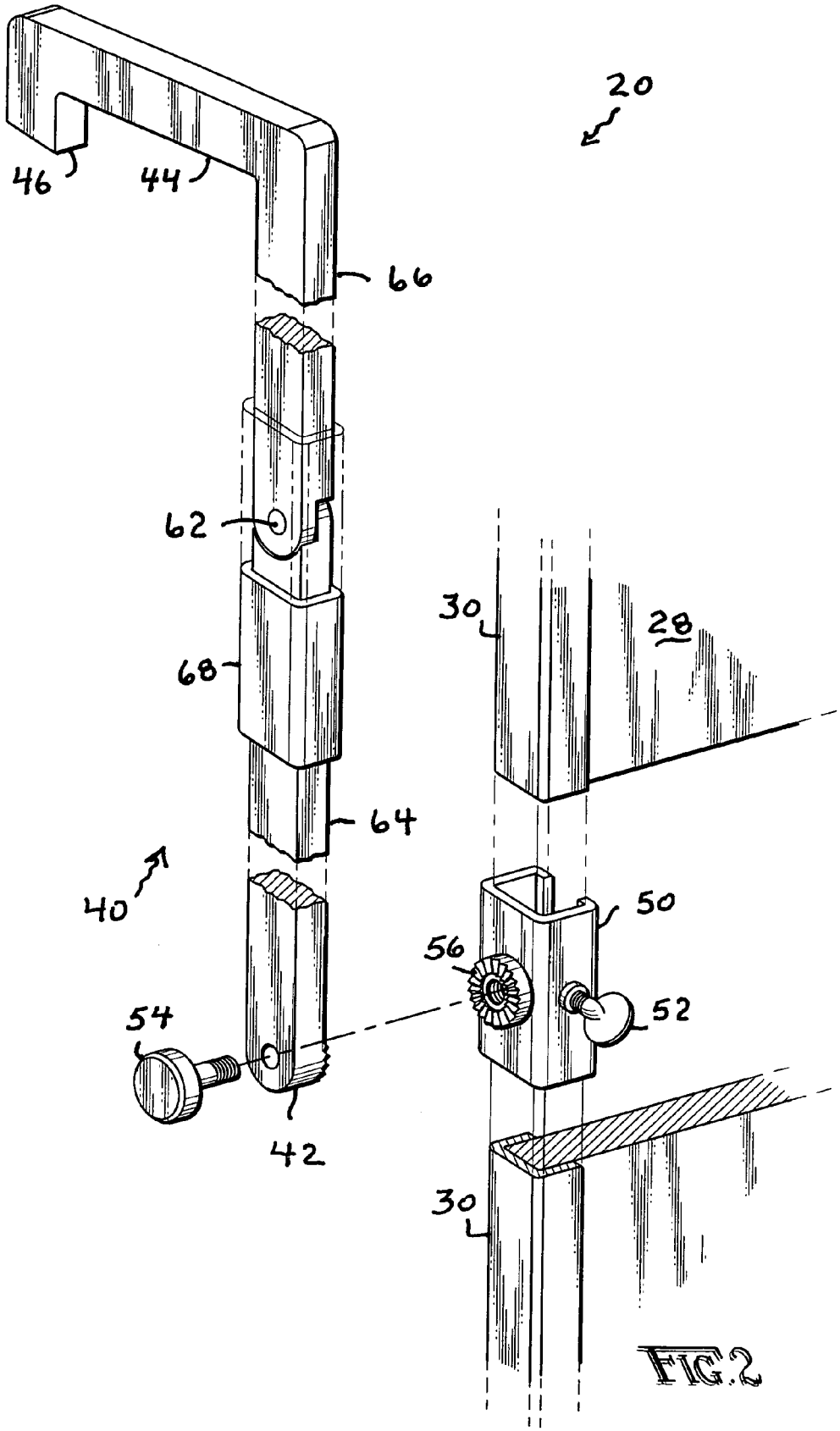
FIG. 2 is an enlarged scale exploded perspective view, with portions broken away, detailing in on the connection between the writing board and one standard.
Figure 3:
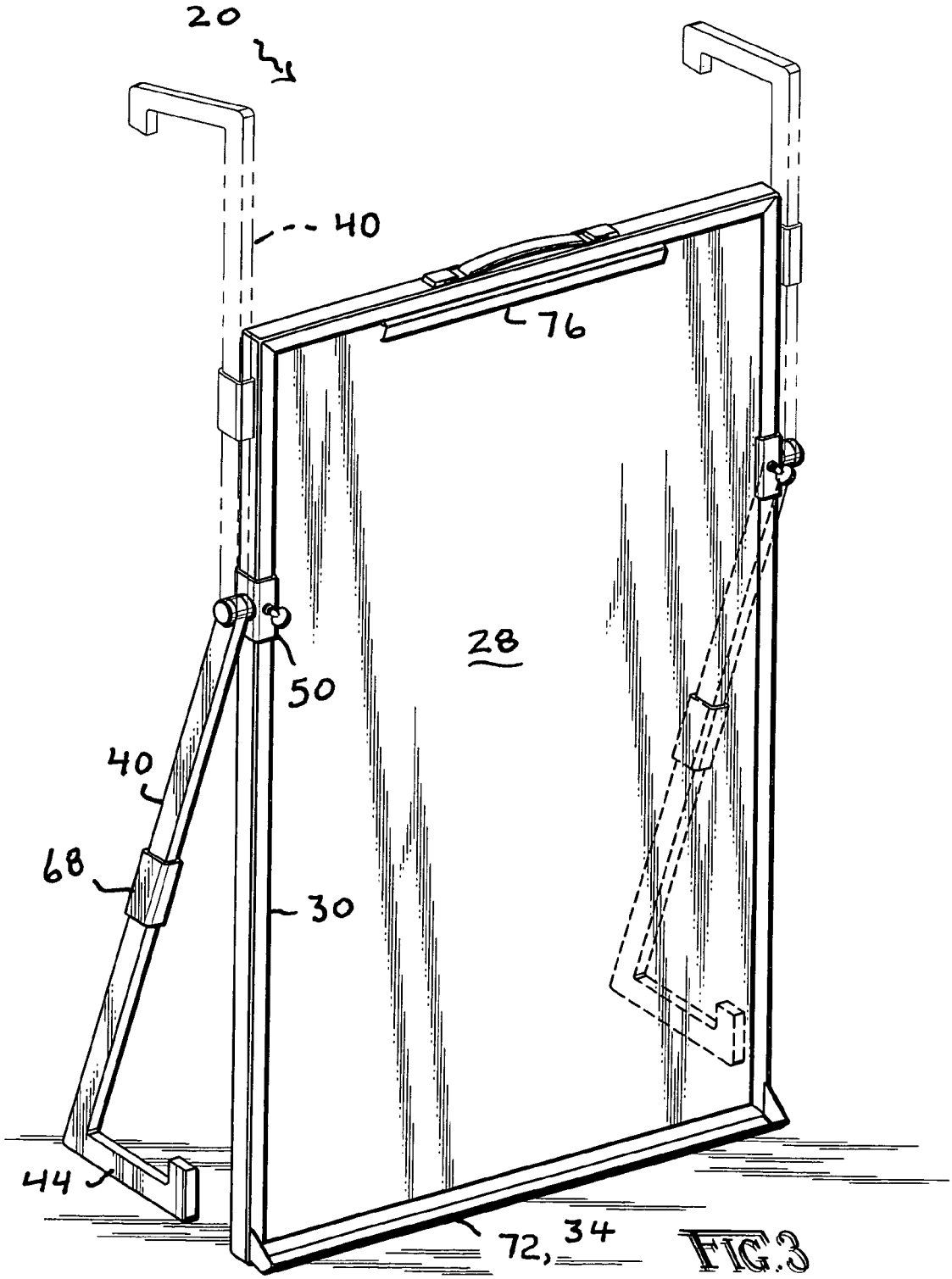
FIG. 3 is a perspective view comparable to FIG. 1 except showing the stand converted in the form of a book easel.
Figure 6:
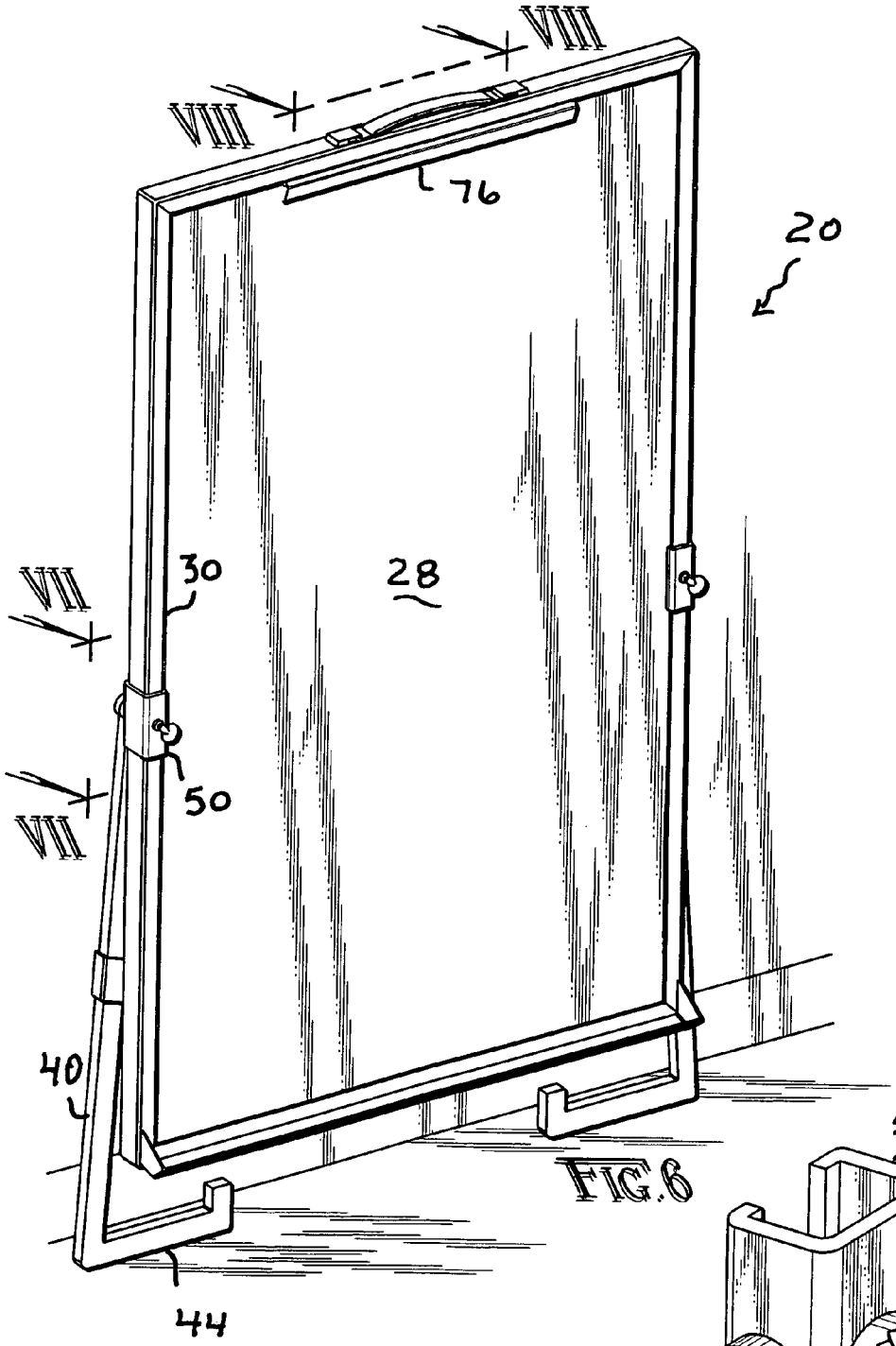
FIG. 6 is a perspective view comparable to FIG. 1 except showing the stand converted in the form of a floor stand.
Figure 7:
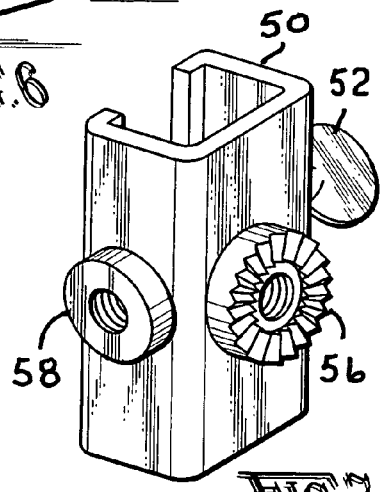
FIG. 7 is an enlarged scale perspective view taken in the direction of arrows VII-VII in FIG. 6 and showing the sliding link in isolation.

As shown better by FIGS. 2, 7 and 6, the stand portion of the invention further includes left and right sliding links 50 that are engaged on the left and right stiles 30 for axially sliding therealong. The sliding links 50 are engaged on the stiles 30 so as not to come off. The sliding links 50 include manually-operated locks for locking the sliding links 50 in fixed axial positions on the stiles 30. These locks comprise hand-tightened thumb screws 52.

The sliding links 50 further include a pair of pivot-formations for forming pivotal link systems with the standards 40, including manually-operated locks for locking the standards 40 in fixed angular positions relative the stiles 30. FIG. 2 shows a twist knob 54 as forming the actual pivot pin and locking device for the system. The twist knob 54 is shown aimed to thread into the threaded socket 56 in the side of the sliding link. This alignment of the twist knob 54 allows the standards 40 to swing in planes generally perpendicular to the writing board. The standard 40 and sliding link 50 are formed with a pair of counter-part face gears. When the twist knob 54 is tightened, the counterpart face gears mesh and increase the holding force against changes in any angularly-locked position.

FIGS. 6 and 7 show that the sliding link 50 has a second threaded socket 58 formed in its backside. Hence the twist knobs 54 and standards 40 can be moved over to utilize the back-side socket. That way, the standards 40 are allowed to swing in planes generally parallel or co-planar to the writing board. Here, there are no face gear formations as with the side socket 56. Hence the locking is achieved disc-brake style, which is sufficient for the purpose.

Returning to FIG. 1, the standards 40 and crook spans 44 are sized and arranged so that the standards 40 can be pivoted and locked as shown so that the writing board can be suspended against a door. To do this, the crook spans 44 disposed above the linked ends 42, and are contained in planes generally perpendicular to the writing board. Thus the crook spans 44 simulate hooks adapted for hooking over a top edge of the door. Preferably the crook spans 44 rake back beyond a right angle in order to, for among other reasons, increase stability when hooked over top edges of doors. Additionally, preferably the crook spans 44 terminate in hooked-back tip ends 46 in order to, for among other reasons, reduce chances of dislodgment of the crook spans 44 when hooked over top edges of doors.

It is an aspect of the invention is convertible to multiple forms. Indeed, FIGS. 3, 4, 6 and 9 show up to four more forms. Starting in FIG. 3, it shows the stand portion of the invention converted into the form of a book easel. Briefly, a book easel is typically intended to rest on a desk or podium. Hence its bottom rail 34 usually rests directly on or not much off the base support surface (eg., the desk or podium). To do this, the standards 40 are preferably pivoted and locked with the crook spans 44 situated generally level with and behind the bottom rail 34 as shown, and thereby prop up the writing board with the crook spans 44 and bottom rail 34 resting on a common base surface.

Figure 4:
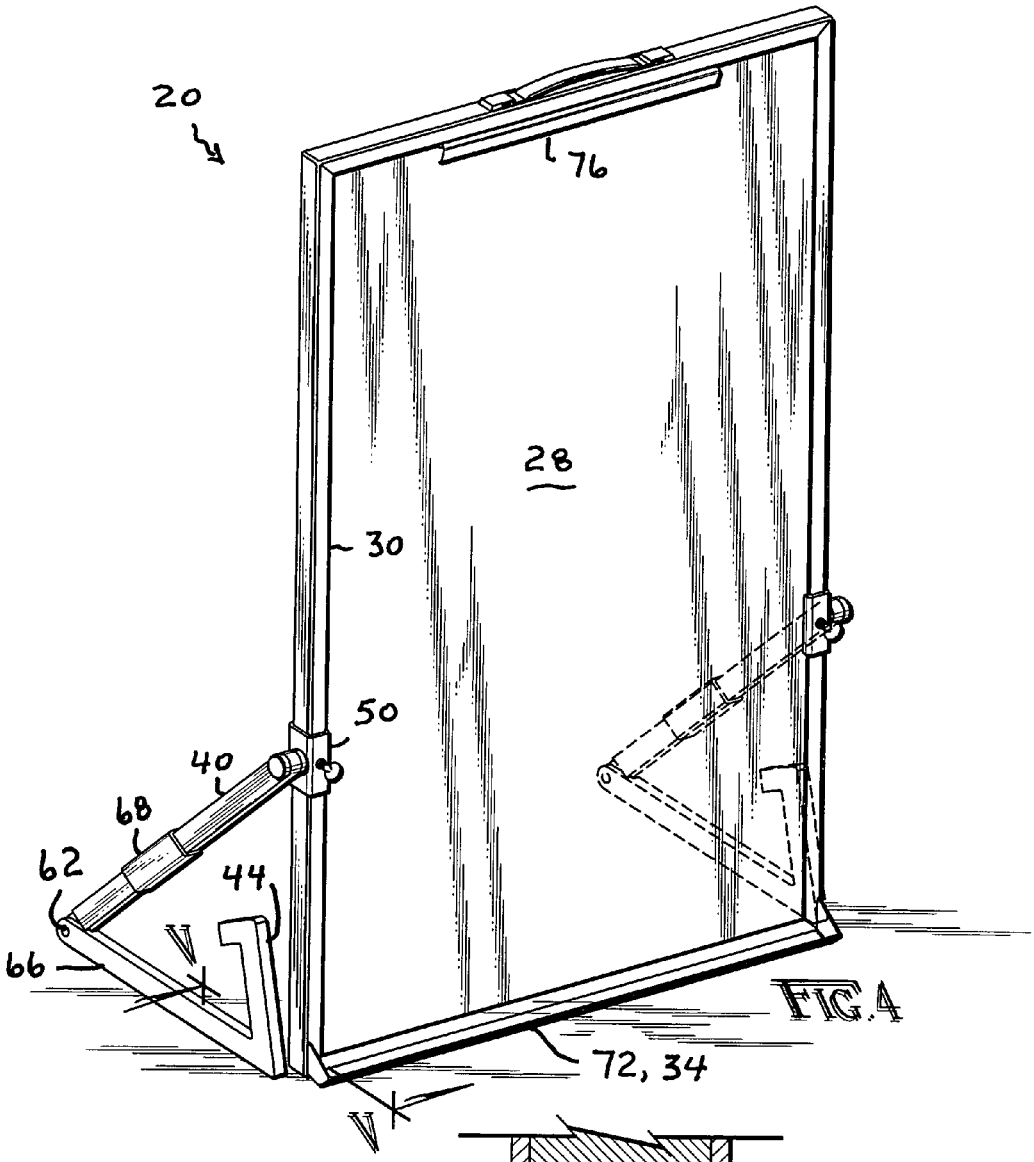
FIG. 4 is a perspective view comparable to FIG. 3 except showing the stand alternatively converted in an alternate form of a book easel.

FIG. 4 shows the stand portion of the invention alternatively converted in an alternate form of a book easel. As FIGS. 2 and 4 together show better, the standards 40 furthermore include being produced with hinged joints 62 intermediate the ends thereof. The joints 62 tend to partition the standards 40 into inner and outer spans 64 and 66. A sliding collar 68 on the standards 40 is slidable and lockable over the joints 62 in extension to at least stiffen the joints 62 straight for utilization of the full extension of the standards 40. The collar 68 holds its place by physical friction. The collars 68 can be slid off the joints 62 to allow flexion. Hence the configuration of FIG. 4 is achieved by pivoting and locking the standards 40 with the joints 62 flexed and situated generally level with and behind the bottom rail 34 as shown, and thereby prop up the writing board with the joints 62 and bottom rail 34 resting on the common base surface (eg., desk or podium).

FIG. 4 might also be reckoned as showing the joints 62 flexed to rest the outer spans 66 flat on the common base surface. Not only that, FIG. 4 might further be reckoned as showing joints 62 flexed to bring the crook spans 44 right up behind the frame's bottom rail 34. Although this is not shown, a pair of short straps with hook-and-pile fastener ends could be attached low on the backside of the frame, one for each of the stiles 30, and thus used to moor the crook spans 44 tightly against the back end of the writing board.

Figure 5:
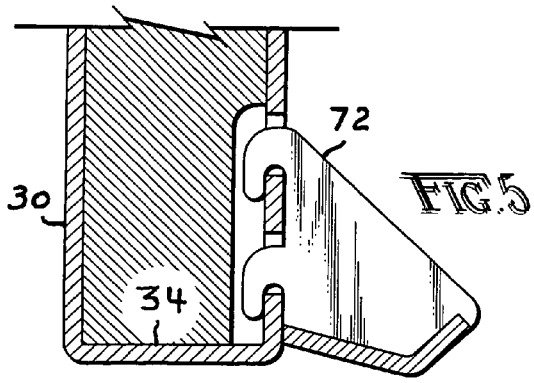
FIG. 5 is an enlarged scale sectional view taken along line V-V in FIG. 4.

FIG. 5 shows that a utensil tray 72 for the writing board (eg., as for chalk or markers, erasers and so on), is not only removably attached but it also serves a second purpose. That is, in particular for the book easel forms of the stand, the tray 72 serves as shelf for propping up Bristol Board tablets and the like (eg., artist's canvases, foam-board slides, and so on, without limitation).

FIG. 4 shows the inclusion of a spring-biased clip 76 along the top rail 32 of the frame for securing papers or documents and the like clipboard-style.

FIG. 6 shows the stand portion of the invention converted into the form of a floor stand. Briefly, a floor stand is typically intended to stand the writing board up to between about waist and chest high off the floor. To this, the standards 40 are pivoted and locked with the crook spans 44 disposed generally level with or lower than the bottom rail 34 as shown, and thereby simulate feet to stand the writing board up off the floor. Furthermore, the standards 40 are switched around to being linked to the stiles 30 such that the crook spans 44 are contained in planes generally parallel with or co-planar to the writing board. That way, the standards 40 stand the writing board up off the floor while simultaneously being leaned against a vertical surface (eg., a wall).

Figure 8:
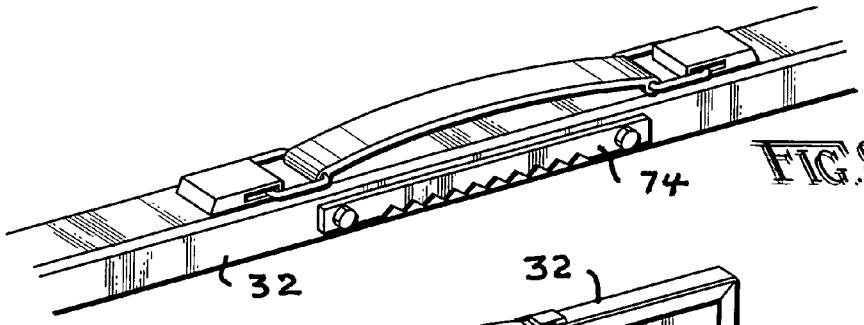
FIG. 8 is an enlarged scale perspective view taken in the direction of arrows VIII-VIII in FIG. 6, with portions broken away.

FIG. 8 shows that writing board has a receiver 74 mounted high up on the backside that is adapted for receiving a picture hanger or nail driven into the wall. This receiver 74 promotes stabilization of the writing board relative against the vertical support surface while the standards 40 provide most of the support of the weight of the writing board. In other words, the standards 40 and receiver 74 are intended to work together in FIG. 6, the standards 40 standing up the writing board, and the receiver 74 preventing the writing board from teetering over.

Figure 9:
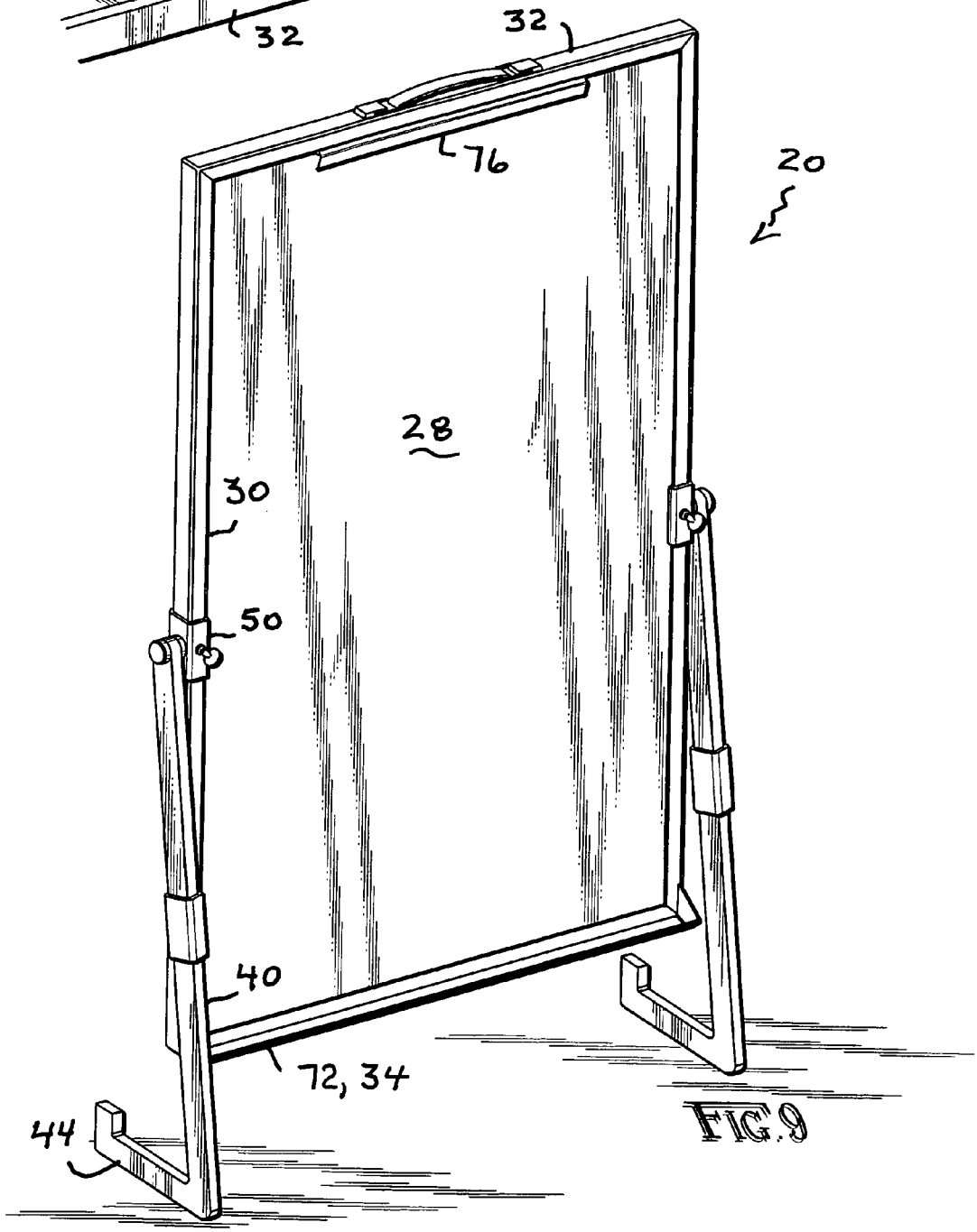
FIG. 9 is a perspective view comparable to FIG. 6 except showing the stand alternatively converted in an alternate form of a floor stand.

FIG. 9 shows the stand portion of the invention alternatively converted into an alternate form of a floor stand. To do this, the standards 40 are pivoted and locked with the crook spans 44 disposed generally level with or lower than the bottom rail 34 as shown, and thereby simulating feet to stand the writing board up off a given base surface. But in contrast to FIG. 6, the standards 40 are linked to the stiles 30 such that the crook spans 44 are contained in planes generally perpendicular to the writing board.

It is an aspect of the invention that the standards 40 are linked to the stiles 30 by the sliding links 50. As previously mentioned, it is conventional to mount writing boards to be situated between about waist and chest high off the floor. However, since users of this writing board might vary in height from that of small children to grown adults, the sliding links 50 allow adjustment of board elevation to the preference of the user, regardless whether the stand is converted to hanging off a door or standing on the floor. Additionally, the sliding links 50 allow the standards 40 to be fixed in positions suitable for converting into the book easel forms shown by FIG. 3 or 4.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A combination writing board and convertible stand, comprising:

a generally planar writing board having a framed portion and a frame of left and right stiles as well as top and bottom rails surrounding the framed portion;

left and right standards extending between linked ends pivotally linked to the left and right stiles, respectively, and free ends formed with crook spans;

manually-operated pivot-locks for locking the standards in fixed angular positions relative the stiles;

wherein the standards and crook spans are sized and arranged so the standards can be:

pivoted and locked with the crook spans disposed above the link ends as well as contained in planes generally perpendicular to the writing board and thereby simulating hooks adapted for hooking over a top edge of a door and thus suspending the writing board for abutting the door, pivoted and locked with the crook spans situated generally level with and behind the bottom rail and thereby prop up the writing board with the crook spans and bottom rail resting on a common base surface, and pivoted and locked with the crook spans disposed generally level with or lower than the bottom rail and thereby simulating feet to stand the writing board up off a given base surface.

2. The combination writing board and convertible stand of claim 1 further comprising:

left and right sliding links engaged on the left and right stiles for axially sliding therealong and formed with pivot-formations for forming pivotal links with the left and right standards, respectively; and manually-operated slide-locks for locking the links in fixed axial positions on the stiles.

3. The combination writing board and convertible stand of claim 1 wherein, with pivoted and locked with the crook spans disposed generally level with or lower than the bottom rail and thereby simulating feet to stand the writing board up off a given base surface, the standards can furthermore be:

linked to the stiles such that the crook spans are contained in planes generally parallel with or co-planar to the writing board and thereby stand the writing board on the given base surface while the writing board leans against a vertical surface.

4. The combination writing board and convertible stand of claim 3 further comprising a receiver mounted high up on the writing board and adapted for receiving a hanger or fastener in the vertical support surface for stabilizing the writing board relative to said vertical support surface.

5. The combination writing board and convertible stand of claim 3 wherein the left and right stiles are provided with dual linking provisions for linking the left and right standards, one which has the standards swinging in planes generally perpendicular to the writing board, and the other which has the standards swinging in planes generally parallel or co-planar to the writing board.

6. The combination writing board and convertible stand of claim 1 wherein:

the standards comprise joints intermediate the ends thereof which partition the standards into inner and outer spans and which are at least releasably lockable in extension; and the standards can furthermore be pivoted and locked with the joints flexed and situated generally level with and behind the bottom rail and thereby prop up the writing board with the joints and bottom rail resting on the common base surface.

7. The combination writing board and convertible stand of claim 6 wherein the joints are flexed to dispose the crook spans proximate the bottom rail.

8. The combination writing board and convertible stand of claim 6 wherein the joints are flexed to rest the outer spans on the common base surface.

9. The combination writing board and convertible stand of claim 1 wherein the crook spans rake back beyond a right angle to increase stability when hooked over the top edge of doors.

10. The combination writing board and convertible stand of claim 1 wherein crook spans terminate in hooked-back tip ends to reduce chances of dislodgment of the crook spans when hooked over the top edge of doors.

11. The combination writing board and convertible stand of claim 1 wherein, with the standards pivoted and locked with the crook spans disposed generally level with or lower than the bottom rail and thereby simulating feet to stand the writing board up off a given base surface, the standards can furthermore be:

linked to the stiles such that the crook spans are contained in planes generally perpendicular to the writing board.

12. The combination writing board and convertible stand of claim 11 further comprising a receiver mounted high up on the writing board and adapted for receiving a hanger or fastener in a vertical support surface for stabilizing the writing board in a lean against said vertical support surface.

13. A combination writing board and convertible stand, comprising:

a generally planar writing board having a framed portion and a frame of left and right stiles as well as top and bottom rails surrounding the framed portion;

left and right standards extending between linked ends pivotally linked to the left and right stiles, respectively, and free ends formed with crook spans;

manually-operated pivot-locks for locking the standards in fixed angular positions relative the stiles;

wherein the standards and crook spans are sized and arranged so the standards can be set in any two settings chosen from the following group:

a) pivoted and locked with the crook spans disposed above the link ends as well as contained in planes generally perpendicular to the writing board and thereby simulating hooks adapted for hooking over a top edge of a door and thus suspending the writing board for abutting the door, b) pivoted and locked with the crook spans situated generally level with and behind the bottom rail and thereby prop up the writing board with the crook spans and bottom rail resting on a common base surface, c) pivoted and locked with the crook spans disposed generally level with or lower than the bottom rail and thereby simulating feet to stand the writing board up off a given base surface, and furthermore linked to the stiles such that the crook spans are contained in planes generally parallel with or co-planar to the writing board and thereby stand the writing board on the given base surface while leaned against a vertical surface, and d) standards pivoted and locked with the crook spans disposed generally level with or lower than the bottom rail and thereby simulating feet to stand the writing board up off a given base surface, and furthermore linked to the stiles such that the crook spans are contained in planes generally perpendicular to the writing board.

14. The combination writing board and convertible stand of claim 13 further comprising:

left and right sliding links engaged on the left and right stiles for axially sliding therealong and formed with pivot-formations for forming pivotal links with the left and right standards, respectively; and manually-operated slide-locks for locking the links in fixed axial positions on the stiles.

15. The combination writing board and convertible stand of claim 13 wherein the left and right stiles are provided with dual linking provisions for linking the left and right standards, one which has the standards swinging in planes generally perpendicular to the writing board, and the other which has the standards swinging in planes generally parallel or co-planar to the writing board.

16. The combination writing board and convertible stand of claim 13 wherein:

the standards comprise joints intermediate the ends thereof which partition the standards into inner and outer spans and which are at least releasably lockable in extension; and the standards can furthermore be pivoted and locked with the joints flexed and situated generally level with and behind the bottom rail and thereby prop up the writing board with the joints and bottom rail resting on the common base surface.

17. The combination writing board and convertible stand of claim 16 wherein the joints are flexed to either dispose the crook spans proximate the bottom rail and/or rest the outer spans on the common base surface.

18. The combination writing board and convertible stand of claim 13 wherein the crook spans rake back beyond a right angle to increase stability when hooked over the top edge of doors.

19. The combination writing board and convertible stand of claim 13 wherein crook spans terminate in hooked-back tip ends to reduce chances of dislodgment of the crook spans when hooked over the top edge of doors.

20. The combination writing board and convertible stand of claim 13 further comprising a receiver mounted high up on the writing board and adapted for receiving a hanger or fastener in the vertical support surface for stabilizing the writing board relative to vertical support surfaces.

* * * * *